US005713777A

United States Patent [19]

Greenwald

[11] Patent Number: 5,713,777

[45] Date of Patent: Feb. 3, 1998

[54] NON-LATEX INFLATABLE HAND PUPPET

[75] Inventor: Robert E. Greenwald, Coon Rapids, Minn.

[73] Assignee: Anagram International, Inc., Minneapolis, Minn.

[21] Appl. No.: 675,382

[22] Filed: Jul. 2, 1996

[51] Int. Cl.[6] ..... A63H 3/06

[52] U.S. Cl. ..... 446/223; 226/327

[58] Field of Search ..... 446/220, 221, 446/222, 223, 224, 225, 226, 327, 328, 329

[56] References Cited

U.S. PATENT DOCUMENTS

| | | | |
|---|---|---|---|
| 2,751,708 | 6/1956 | Plummer | 446/223 |
| 3,163,419 | 12/1964 | Lemelson | 446/220 |
| 4,318,244 | 3/1982 | Magid et al. | 446/221 |
| 4,504,240 | 3/1985 | Thomas | 446/327 |
| 5,079,778 | 1/1992 | Sloot | 446/220 |
| 5,108,339 | 4/1992 | Kieves | 446/220 |
| 5,169,353 | 12/1992 | Myers | 446/221 |
| 5,218,721 | 6/1993 | Mathews et al. | 446/220 |
| 5,573,439 | 11/1996 | Turner et al. | 446/220 |

*Primary Examiner*—Robert A. Hafer
*Assistant Examiner*—Jeffrey D. Carlson
*Attorney, Agent, or Firm*—McDonnell Boehnen Hulbert & Berghoff

[57] ABSTRACT

A non-latex inflatable toy in the form of a hand puppet is disclosed. The puppet includes three sheets defining an inflatable chamber and a pocket for the hand of the user.

2 Claims, 1 Drawing Sheet

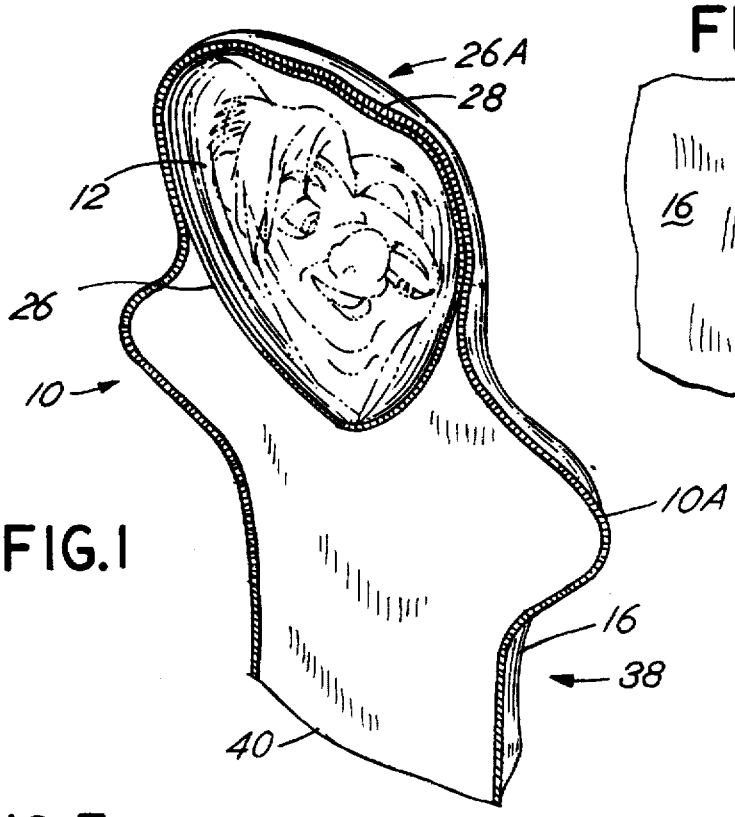
FIG.1
FIG.2
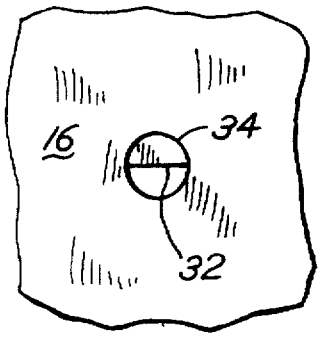
FIG.3
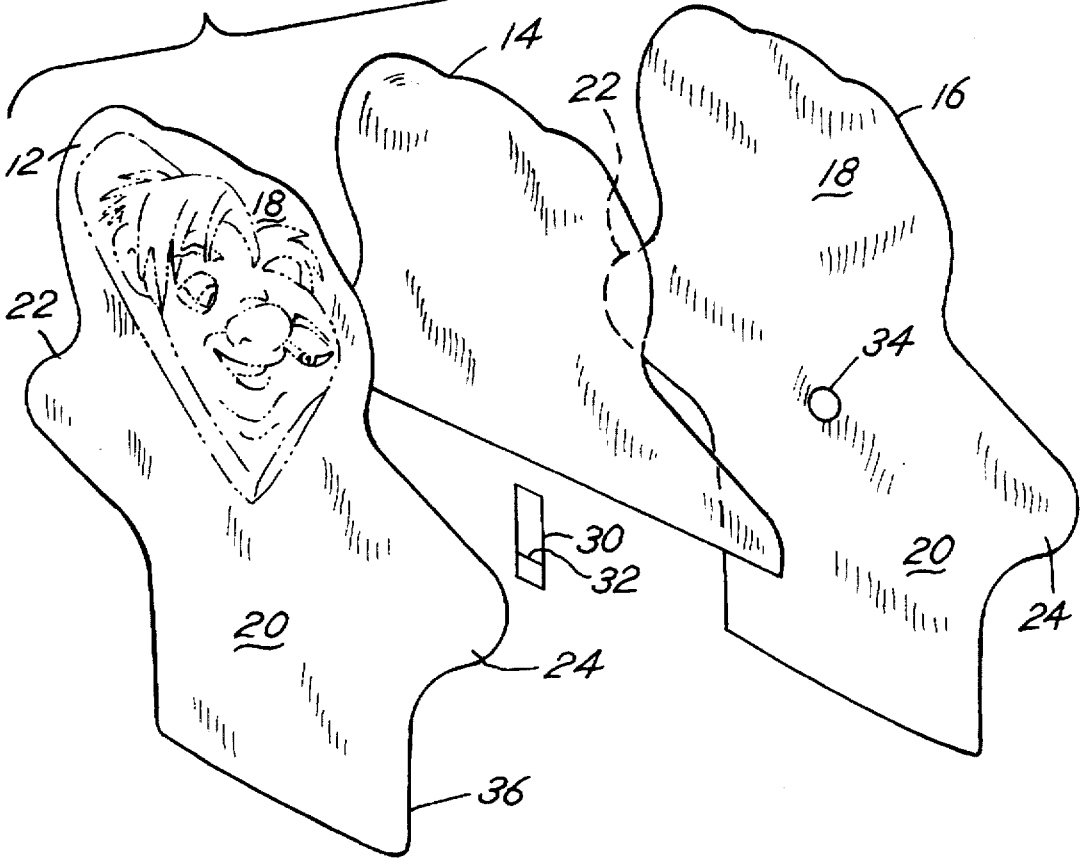

NON-LATEX INFLATABLE HAND PUPPET

BACKGROUND OF THE INVENTION

The present invention relates generally to a toy and more particularly to a non-latex inflatable hand puppet.

The non-latex balloon industry has grown significantly over the past ten years. This type of balloon typically includes metallized and decorated sheets joined to form an inflatable chamber. When filled with helium, the balloon "floats" for an extended period of time. In this context, the teachings of U.S. Pat. Nos. 4,077,588; 4,290,763; and 4,917,646 are incorporated herein by reference.

Related products have also been developed. One such product involves multiple balloons interconnected to provide a human-like or animal-like appearance. Another involves air-filled balloons. In this context, the teachings of U.S. Pat. Nos. 4,778,431 and 5,243,707 are incorporated herein by reference.

SUMMARY OF THE INVENTION

In a principal aspect, the present invention is a non-latex inflatable toy in the form of a hand puppet. The puppet includes three sheets of plastic joined to provide an inflatable chamber and a pocket. The inflatable chamber receives and holds an inflation gas, such as air. The pocket receives the hand of a user.

It is thus an object of the present invention to provide a novel and unique novelty product. Another object is an inexpensive inflatable toy. Still another object is a readily manufactured non-latex inflatable hand puppet.

These and other features, objects and advantages are set forth or implicit in the following detailed description.

BRIEF DESCRIPTION OF THE DRAWING

A preferred embodiment of the present invention is described, in detail, with reference to the drawing wherein:

FIG. 1 is a perspective view of the present invention in an inflated state;

FIG. 2 is an enlarged partial back view thereof; and

FIG. 3 is an exploded perspective view of the present invention in an unfilled state.

DETAILED DESCRIPTION OF A PREFERRED EMBODIMENT

A preferred embodiment of the present invention is shown in FIG. 1 as a novelty toy in the form of a non-latex inflatable hand puppet, generally designated 10. The puppet 10 includes three plastic sheets 12, 14, 16, respectively, secured along their outer peripheries (excluding the lower or bottom edges thereof) by a heat seal 10A.

The first and third sheets 12, 16 are preferably metallized on one side, i.e., the outer side, and the metallized side of the first sheet 12 is preferably decorated with a human-like image as shown. Preferably the first or front sheet 12 and the third sheet 16 are substantially the same shape and size, i.e., the sheets 12, 16 are substantially coextensive. Each of the sheets 12, 16 includes a head portion 18, a body portion 20 and a pair of substantially opposed lateral arm portions 22, 24 respectively. In the assembled state, the puppet 10 thus has an overall human-like appearance and is operable in a human-like manner by the user.

The second sheet 14 corresponds generally to the head portion 18 of the first sheet 12 and is further joined thereto by a heat seal 26 to provide an inflatable balloon, generally designated 26A. More particularly, the first and second sheets 12, 14 define an inflatable chamber 28 to receive and hold an inflation gas, typically air. In this preferred embodiment, the puppet 10 includes a self-sealing valve 30 in communication with and extending from the inflatable chamber 28. As best shown in FIG. 3, the valve 30 extends downwardly from the inflatable chamber 28 when the puppet 10 is in a substantially upright orientation.

The self-sealing valve 30 includes an inlet 32, adapted to receive an inflation nozzle (not shown), and the inlet 32 interposes the first and third sheets 12, 16 in the assembled state. For access to the inlet 32, the third or back sheet 16 defines an inflation aperture 34, substantially aligned with the inlet 32.

The body portion 20 and arm portions 22, 24 cooperatively define an extension 36, i.e., a portion of the first sheet 12 extending beyond the second sheet 14. In the assembled state, the third sheet 16 overlays the second sheet 14 and at least partially overlays the extension 36 to define a pocket, generally designated 38. The pocket 38, having an open lower end 40, is adapted to receive the hand of the user, such that the puppet 10 may be maneuvered in a human-like fashion.

A single preferred embodiment has been described herein. The true scope and spirit of the present invention are, however, defined by the following claims to be read and interpreted in view of the foregoing.

What is claimed is:

1. An inflatable toy comprising, in combination:

an inflatable decorated balloon having a predetermined shape, and including a first sheet, a second sheet and a self-sealing valve having an inlet, said first and second sheets joined to define an inflatable chamber therebetween, said self-sealing valve communicating with and extending from said inflatable chamber, said first sheet having an extension beyond said second sheet;

a third sheet joined to said first sheet and overlaying said inflatable chamber and at least partially overlaying said extension, said first and third sheets defining a packet;

said inlet of said self-sealing valve being interposed said first and third sheets and within said pocket, said third sheet defining an inflation aperture substantially aligned with said valve inlet.

2. An inflatable toy as claimed in claim 1 wherein said first and third sheets further define a pair of substantially opposed lateral extensions.

* * * * *